United States Patent [19]

Eiermann

[11] Patent Number: 4,793,304

[45] Date of Patent: Dec. 27, 1988

[54] ARRANGEMENT FOR COOLING THE PISTON OF A ROTARY PISTON INTERNAL COMBUSTION ENGINE

[75] Inventor: Dankwart Eiermann, Weissensberg, Fed. Rep. of Germany

[73] Assignee: Wankel GmbH, Berlin, Fed. Rep. of Germany

[21] Appl. No.: 92,350

[22] PCT Filed: Nov. 8, 1985

[86] PCT No.: PCT/DE85/00444

§ 371 Date: Sep. 8, 1987

§ 102(e) Date: Sep. 8, 1987

[87] PCT Pub. No.: WO87/03040

PCT Pub. Date: May 21, 1987

[30] Foreign Application Priority Data

May 11, 1984 [DE] Fed. Rep. of Germany ..... 3417488

[51] Int. Cl.[4] ..... F02B 53/10

[52] U.S. Cl. ..... 123/205; 418/86

[58] Field of Search ..... 123/205; 418/86, 91, 418/99, 100

[56] References Cited

U.S. PATENT DOCUMENTS 3,176,915 4/1965 Bentele et al. ..... 418/91 X
3,180,323 4/1965 Paschke ..... 418/86
3,196,852 7/1965 Bentele .
3,240,189 3/1966 Stumpfig ..... 123/205 X

FOREIGN PATENT DOCUMENTS 1509806 5/1978 United Kingdom .

*Primary Examiner*—Michael Koczo
*Attorney, Agent, or Firm*—Becker & Becker, Inc.

[57] ABSTRACT

In a mixed cooling system for the piston of a rotary-piston internal combustion engine having a trochoid construction with a triangular piston and a liner surface in the form of a double arc of a circle, a fuel injector is arranged in a side-wall of the liner and its jet is directed toward the inside wall of the corresponding corner of the piston which forms the driving corner of the expansion chamber when the piston is about to reach its bottom dead point. The starting of the injection cycle is determined by a piston position in which the corner of the piston forming the driving corner of the expansion chamber intersects the straight line located in the axis of the injection jet, and the end of the injection cycle is determined by a piston position in which the driving corner of the expansion chamber has moved past the exhaust opening.

3 Claims, 5 Drawing Sheets

ARRANGEMENT FOR COOLING THE PISTON OF A ROTARY PISTON INTERNAL COMBUSTION ENGINE

BACKGROUND OF THE INVENTION

The present invention relates to an arrangement for cooling the piston of a rotary piston internal combustion engine that includes a housing which has a central portion with a trochoidal liner surface in the form of a double arc of a circle, and also has two side portions; a eccentric shaft passes through the housing at right angles thereto, and has an eccentric on which rotates, at a speed ratio of 2:3 relative to the rotation of the shaft, a triangular piston that is cooled by a mixture of fuel and air that flows therethrough.

An engine of this type is described in DE-OS No. 25 53 47, FIG. 7 (DE-P No. 25 60 063), where a partial stream of the fuel and air mixture is conveyed through the piston to cool the latter, and is conveyed via a channel in one or both side walls into side inlets. This partial stream is a rich mixture, so that due to the evaporation of the fuel contained therein on the hot inner walls of the piston, a better cooling effect, and at the same a preparation of the fuel, is achieved. The fuel is supplied to the air for combustion via a carburetor. The introduction of the intake air, or of the fuel and air mixture, into the piston for the purpose of cooling the latter was already mentioned in DE-AS No. 1 136 532.

However, especially at higher engine loads, such an air or mixture cooling of the piston is unsatisfactory and cannot cool the particularly thermally stressed parts any more than the less stressed parts.

The heat distribution on the piston results from the spreading of the flame in the direction of rotation; consequently, the highest temperatures occur at the center of the leading part of the respective piston side and near the leading piston corner, whereas the trailing part of the piston side remains relatively cool. The temperatures at full load, which reach up to 500° C., result in the carbonization of oil (formation of carbon deposits) that calls in question a lubrication of the sealing elements and cakes the latter in their grooves. This results in leakiness of the working chambers, high wear, and failure of the engine. It is customarily attempted to reduce the temperatures by appropriate guidance of air within the piston, and by additional cooling ribs on the housing. However, the problem always produces transfer of heat in the direction toward the piston bearing, so that cooling of the housing is ineffective. On the other hand, internal cooling of the piston with gas as such can be increased considerably even during a preferred directing of the gas stream against the hot corner regions.

It is an object of the present invention, with the aforementioned type of engines, to achieve an additional effective cooling of the piston in the region of the high-temperature-stressed leading part of the piston side, and to thereby make such engines having air or mixture cooled pistons also usable for high loads, as is possible with such engines that have liquid-cooled pistons. A further object of the present invention is to bring about, with the same features, an effective preparation of the fuel already prior to introduction of the fuel and air mixture into the working chamber.

SUMMARY OF THE INVENTION

The cooling arrangement of the present invention is characterized primarily by a fuel injector that is disposed in one of the side portions of the housing in such a way that the center line of the injection jet or spray of the fuel injector is directed toward that corner of the piston which leads the respective expansion chamber, as well as toward the axial center of the inside wall of this corner, when the piston passes a position which, within a rotation of the eccentric shaft, is 30° to 10° before the piston reaches its bottom dead-center position.

BRIEF DESCRIPTION OF THE DRAWINGS

One exemplary embodiment of the invention is described subsequently with the aid of the drawings, in which.

DESCRIPTION OF PREFERRED EMBODIMENTS

Figure 1:
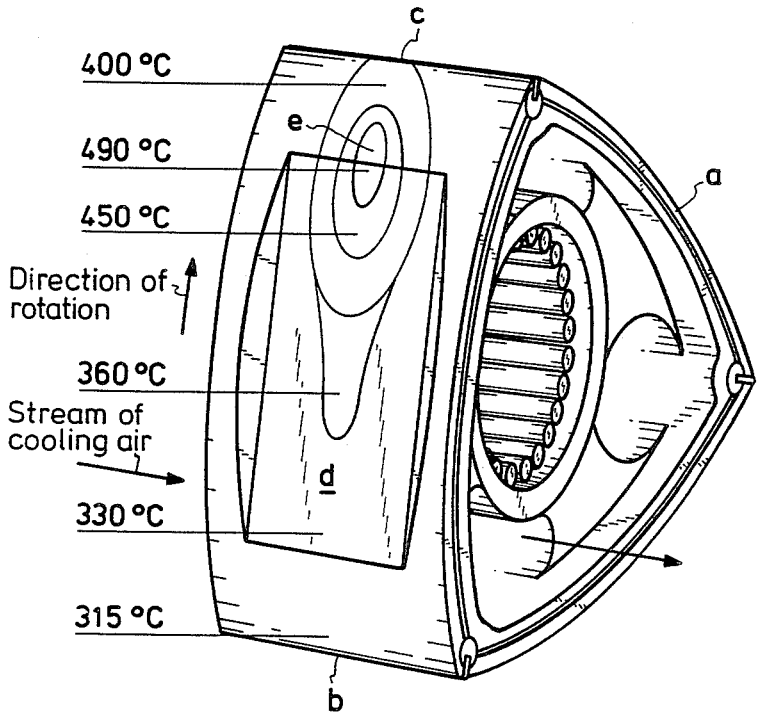
FIG. 1 is a perspective illustration of the piston showing the heat profile during fullload operation.

FIG. 1 shows the temperature distribution on the side of an air-cooled piston a of the initially indicated type of engine at 5500 rpm at full load. The trailing piston edge b has temperatures of about 310° to 320° C. In the direction toward the driving or leading piston edge c, the temperature in the piston trough d rises to 400° to 450° C., reaching 490° C. in the center at the leading trough end e near the leading piston edge c. These temperatures are incompatible with the operation of such an engine due to the thereby resulting carbonization of oil (formation of carbon deposits).

Figure 2:
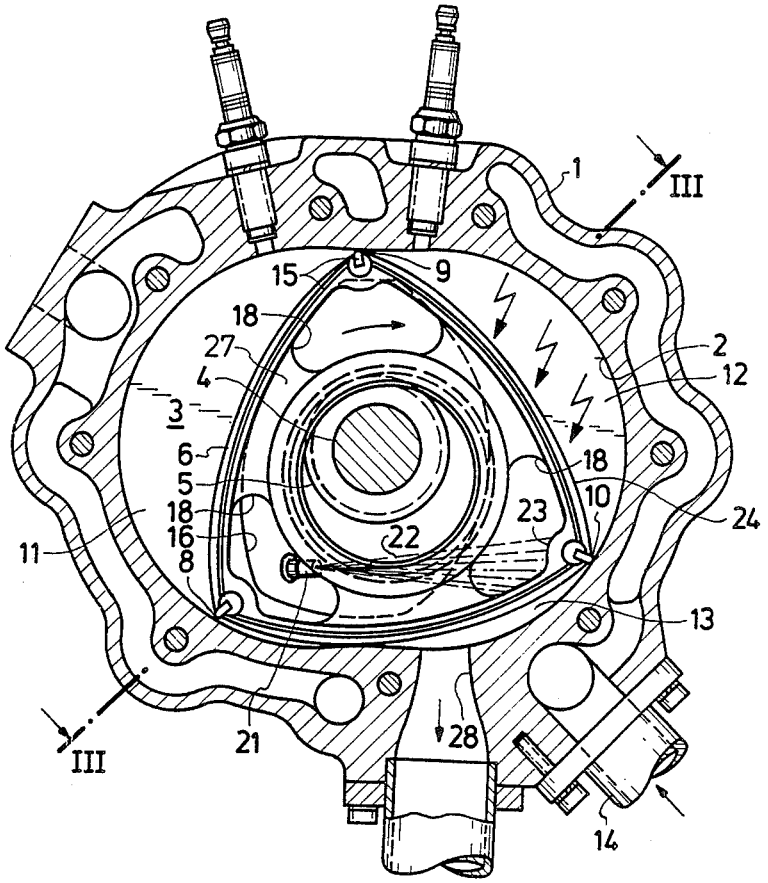
FIG. 2 is a radial cross-sectional view through an inventive engine taken along the line II—II in FIG. 3.

The radial cross-sectional view of FIG. 2 shows the central portion 1 of the housing with the trochoidal liner surface 2 in the form of a double arc of a circle, and also shows the right side portion 3 (see FIG. 3) through which the shaft 4 passes at right angles. The piston 6 rotates on the eccentric 5 with a planetary-type movement. The piston 6 has corners 8, 9, and 10. As it moves, this piston alternately forms an intake and compression chamber 11, an expansion chamber 12, and an exhaust chamber 13.

Figure 3:
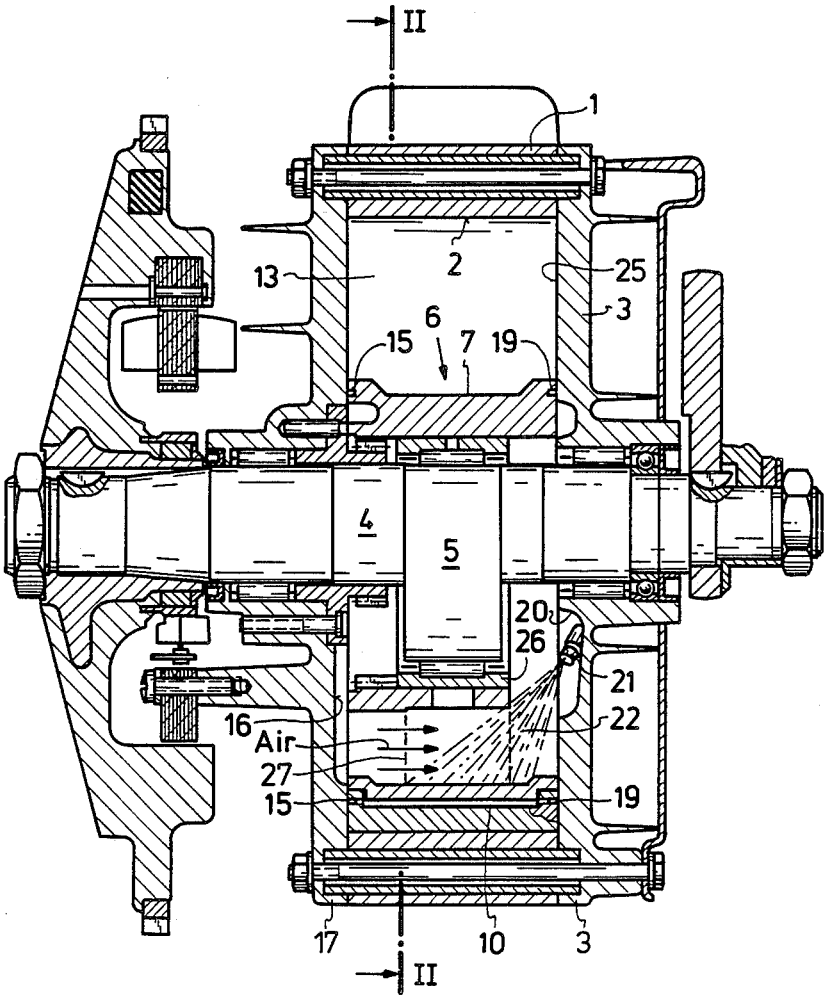
FIG. 3 is an axial cross-sectional view through the same engine taken along the line III—III in FIG. 2.

The introduction of the air for combustion is effected via the inlet 14 into the recess 16, over which the sealing strips 15 of the piston 6 do not pass, and which, in FIG. 3, is in the left side portion 17; the recess 16 is open toward the piston 6. The air for combustion flows through the openings 18 provided in the piston in the region of the corners 8, 9, and 10 thereof, and flows into a recess 20 which is similarly open toward the piston and over which the sealing strips 19 of the piston 6 do not pass; the recess 20 is disposed in the right side portion 3 (FIG. 3). The recess 20 communicates with the non-illustrated side inlet, which similarly is a recess in the side portion 3.

The intake air subsequently flows through the piston 6 in the direction from left to right in FIG. 3.

Provided in the side portion 3, across from that corner of the side inlet which is the leading corner in the direction of rotation, in the recess 20, is an injector 21, the injection jet or spray 22 of which, every time the piston 6 is about to reach its bottom dead-center position, as shown in FIG. 2, is directed centrally against the inside wall 23 of the leading corner 10 of the expansion chamber 12. The control periods of the injection are effected as the inside wall 23 of the leading corner 10 of the expansion chamber 12, and as the hereto connected inside wall of the leading portion 24 of that side 7 of the piston 6 pertaining to the expansion chamber 12, pass, i.e. during the hottest region illustrated in FIG. 1. The injector 21 does not extend beyond the side wall 25 of the side portion 3. The interior wall 27 of the piston 6 supports the eccentric bearing 26 and is reduced to the width of the eccentric 5 in order to provide room for the injection spray 22, i.e. is reduced on the side of the injector 21 up to the edge of the bearing 26.

Figure 4:
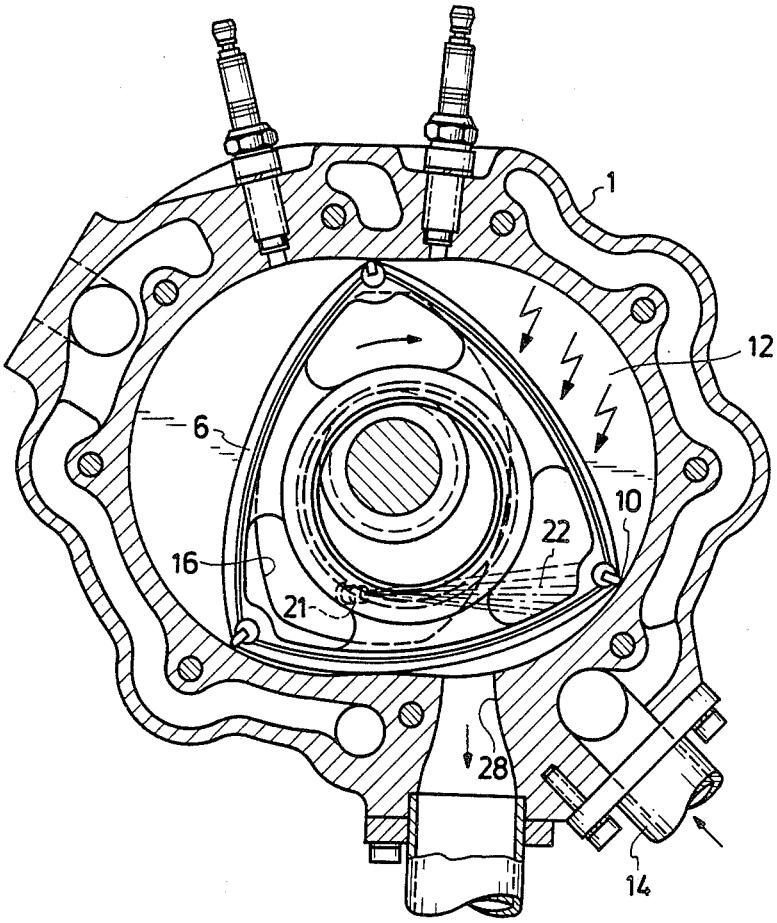
FIG. 4 is a radial cross-sectional view similar to that of FIG. 2 with the position of the piston at the start of injection.
Figure 5:
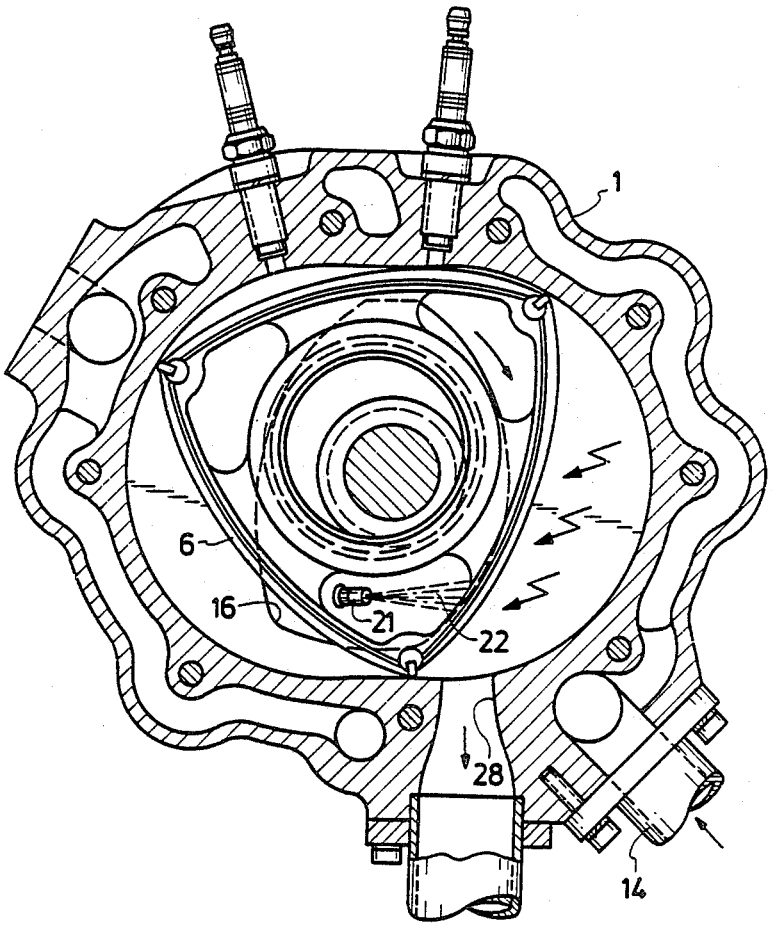
FIG. 5 is the same radial crosssectional view as in FIG. 4 with the position of the piston at conclusion of injection.

Advantageous control times are shown in FIGS. 4 and 5, with FIG. 4 illustrating the piston position at the point in time of the start of the injection cycle, in which position the center line of the injection spray 22 intersects the leading corner 10 of the expansion chamber 12, i.e., the impact surface area of the injection spray 22 also reaches that region of the inside piston wall that is ahead of this corner 10. FIG. 5 shows the end of the injection cycle at a piston position in which the same piston corner 10 has just passed over the outlet 28.

With this arrangement, the hottest region of the piston 6, and in particular the sealing parts 15, 19 of the piston corners 8, 9, and 10, are reliably cooled. At the same time, a good preparation of the fuel, and a thorough mixing with the air for combustion, results since the injection is effected counter to the direction of the intake air that is flowing through the piston, so that a homogenous fuel-air mixture is already formed due to the hereby achieved swirling of the fuel that is evaporated from the hot inside wall of the piston with the intake air upon entry into the working chamber. The present invention is, of course, in no way restricted to the specific disclosure of the specification and drawings, but also encompasses any modifications within the scope of the appended claims.

I claim:

1. An arrangement for cooling the piston of a rotary piston internal combustion engine that includes a housing which has a central portion with a trochoidal liner surface in the form of a double arc of a circle, and also has two side portions; a shaft passes through said housing at right angles thereto, and has an eccentric on which rotates, within said housing, and at a speed ratio of 2:3 relative to the rotation of said shaft, a triangular piston that is cooled by a mixture of fuel and air that flows therethrough, said piston having corners that move along said liner surface and have inside walls, with said piston, during its movement with said housing, alternatively forming with said liner surface an intake compression chamber, an expansion chamber, and an exhaust chamber; said arrangement further comprises:

a fuel injector disposed in one of said side portions in such a way that the center line of the injection spray of said injector is directed toward that corner of said piston which leads the respective expansion chamber, as well as toward the axial center of said inside wall of this corner, when said piston passes a position which, within a rotation of said shaft, is 30° to 10° before said piston reaches its bottom deadcenter position.

2. An arrangement according to claim 1, in which an inlet for intake air is provided in the other of said side portions so that said intake air flows through said piston in a direction counter to the direction of said injection spray.

3. An arrangement according to claim 1, in which said housing includes an outlet; in which the start of an injection cycle is determined by a position of said piston in which that corner of piston that is the leading corner of the respective expansion chamber intersects a straight line located in the center line of said injection spray; and in which conclusion of said injection cycle is determined by a position of said piston in which said leading corner of said expansion chamber has moved past said outlet of said housing

* * * * *